US007273240B2

(12) United States Patent
Migli

(10) Patent No.: US 7,273,240 B2
(45) Date of Patent: Sep. 25, 2007

(54) CLOSING DEVICE FOR FURNITURE

(75) Inventor: Carlo Migli, Lecco LC (IT)

(73) Assignee: Agostino Ferrari S.p.A. (IT)

( * ) Notice: Subject to any disclaimer, the term of this patent is extended or adjusted under 35 U.S.C. 154(b) by 0 days.

(21) Appl. No.: 11/129,336

(22) Filed: May 16, 2005

(65) Prior Publication Data

US 2005/0268432 A1 Dec. 8, 2005

(30) Foreign Application Priority Data

May 21, 2004 (IT) ..... MI2004A1020

(51) Int. Cl.
*E05C 19/16* (2006.01)
*E05B 63/20* (2006.01)

(52) U.S. Cl. ..... 292/251.5; 292/332; 292/333; 292/337; 292/DIG. 4; 292/DIG. 37

(58) Field of Classification Search ..... 292/251.5, 292/332, 333, 337, DIG. 4, DIG. 15, DIG. 37; 16/258
See application file for complete search history.

(56) References Cited

U.S. PATENT DOCUMENTS 3,376,088 A 4/1968 Bol et al.
3,451,707 A * 6/1969 Barry ..... 292/251.5
3,492,037 A * 1/1970 Hutchinson ..... 292/251.5
4,227,726 A 10/1980 Sorimachi et al.
4,249,761 A 2/1981 Nishimura
4,270,781 A * 6/1981 Nishimura ..... 292/251.5
4,702,506 A * 10/1987 Iimura ..... 292/251.5
4,736,494 A * 4/1988 Marchesi ..... 24/303
5,709,421 A * 1/1998 Gillham ..... 292/251.5
5,836,049 A * 11/1998 Chiang ..... 16/82
6,588,809 B1 * 7/2003 Derman ..... 292/129
6,630,877 B2 * 10/2003 Manthey ..... 335/205

FOREIGN PATENT DOCUMENTS

DE 40 11 722 A1 10/1990
GB 2215771 A 9/1989
JP 0441880 * 4/1992

* cited by examiner

*Primary Examiner*—Carlos Lugo
(74) *Attorney, Agent, or Firm*—Shlesinger & Fitzsimmons

(57) ABSTRACT

A closing device for an opening part of a piece of furniture comprises a magnetic detent for retention of the part in a closed position in combination with a thrust "pull-push" mechanism for detachment from the magnetic detent upon command, so as to cause opening of the opening part of the piece of furniture.

16 Claims, 4 Drawing Sheets

CLOSING DEVICE FOR FURNITURE

BACKGROUND OF THE INVENTION

1. Field of the Invention

The present invention relates to a closing device for furniture comprising a combination of a magnetic-retention system and a mechanical opening "pull-push" system.

2. State of the Prior Art

In current traditional applications, furniture hinges are equipped with a spring mechanism enabling automatic closure of the door starting from a predetermined closure angle. Under this situation, the door is opened by exerting a pulling action on the handle until overcoming the closure angle and keeps open as far as it is not pushed again towards the direction of action of the automatic closure mechanism.

In some applications use of handleless doors is preferred; in this case suitable pawls known as "pull-push" systems are mounted that, if the door is manually pushed against the flank's ledge, they alternately retain the door in the closed position or release and separate it some millimeters from the flank by means of a spring mechanism. These systems are also used in drawers or other opening parts of a piece of furniture.

Different systems exist for accomplishing the "pull-push" mechanism, but irrespective of the different embodiments, all known systems can be brought back to a single operating principle, i.e. they consist of two main components, one to be mounted on the fixed part. (the flank or horizontal elements, for example) and the other to be mounted on the moving part (the door or front portion of a drawer, for example). One of the two components has no moving parts and has one or more hooking surfaces at undercut regions relative to the perpendicular to the inner surface of the door in a closed position; generally fastening of this first component to the moving part is preferred, due to the smaller overall dimensions thereof. The second component, to be fastened to the other element of the piece of furniture, contains the hooking mechanism that through successive pushes of the door towards the closing ledge, alternately engages in the undercut of the first component causing retention of the door, or is released therefrom and enables opening of the door. These devices, irrespective of their mechanical features, have different drawbacks that are intrinsic in their operating principle: the two components contain elements that must get co-coordinated during closure and must mutually slide to lock and release the door; it is therefore apparent that a great accuracy is required for fastening of same; since generally the "pull-push" mechanism is fastened to the free end of the door, it is apparent that this accuracy can be hardly reached; in addition to tolerances on the sizes of the door and flanks, it is necessary to consider possible mistakes on fastening of the hinges, yielding of the hinges themselves due to wear, and adjustments of the door relative to the piece of furniture, all these factors bringing to even important shiftings relative to the theoretical-abutment position of the door against the furniture flank. In some cases, the mutual shifting between the door and flank can cause the serious drawback of locking the door to the closed position; since the hooking system is rigid, under extreme conditions it may be necessary to break the mechanism so as to open the door. A further drawback consists in the geometry of the hooking tooth obliging either to have projecting parts on the inner surface of the door or, alternatively, to embed the tooth into a hole.

It is a general aim of the present invention to obviate the above mentioned drawbacks by providing a closing device that has a "pull-push" operation but, among other things, does not require a particular precise alignment between the fixed and moving parts and can be released by a mere pulling action, when desired.

SUMMARY OF THE INVENTION

In view of the above aim, in accordance with the invention, a closing device for an opening part of a piece of furniture has been conceived which comprises a magnetic detent for retention of the part in a closed position in combination with a thrust "pull-push" mechanism for detachment of the part from the magnetic detent upon command, so as to cause opening of said part.

BRIEF DESCRIPTION OF THE DRAWINGS

For better explaining the innovative principles of the present invention and the advantages it offers over the known art, possible embodiments applying said principles will be described hereinafter by way of example with the aid of the accompanying drawings. In the drawings.

DETAILED DESCRIPTION OF THE INVENTION

Figure 1:
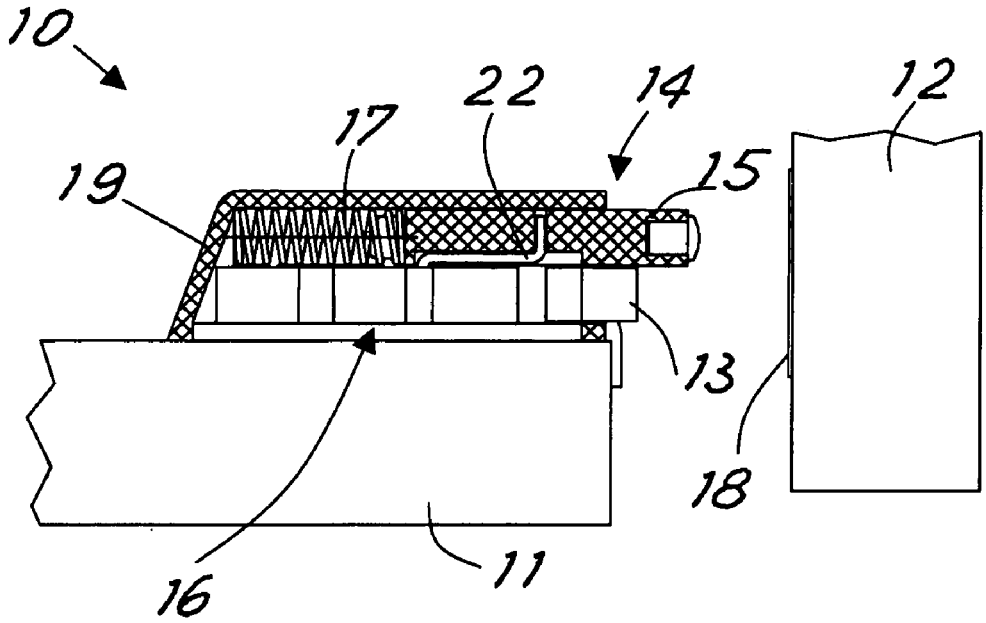
FIG. 1 is a diagrammatic side view in longitudinal section of a closing device in accordance with the invention, in an open position.

With reference to the figures, a first embodiment of a device generally denoted at 10 and made following the innovative principles of the present invention is shown in FIG. 1. The device 10 is designed to be fastened to the shoulder 11 of a piece of furniture (or other element defining a closeable compartment) to act on an opening part 12 of the piece of furniture. The opening part can be a drawer, a door, etc. for example, as can be easily envisaged by a person skilled in the art. This part can therefore rotate, translate, or carry out a rotation-translation movement, by means of hinges or guides for example.

The device 10 comprises a magnetic detent in turn including one magnet 13, for retention of the moving part 12 in a closed position, and a thrust "pull-push" mechanism 14 for detachment of the part 12 from the magnetic detent upon command, so as to enable opening of said part.

In more detail, the "pull-push" mechanism 14 comprises an element 15 suitable for a thrust action on the opening part 12 with a higher force than the magnet attraction, to cause detachment thereof from the magnetic detent. The thrust element 15 is made slidable between an advanced detachment position (shown in FIG. 1) and a retracted rest position (shown in FIG. 2). Due to the presence of a cam device 16, a "pull-push" mechanism is produced that enables alternate and steady passage between the two, i.e. advanced and retracted, positions, by manual thrust on the element 15 against the action of a spring 17, in the closing direction and beyond the retracted rest position (as clarified in the following).

As still viewed from FIG. 1, the attraction magnet 13, disposed in side by side relationship with the thrust element 15, has a front surface that is a contact surface with an element of ferromagnetic material 18 (in the form of an iron or steel plate, for example) fastened to the opening part 12. The device is conveniently sized so that said front surface of the magnet projects less than the thrust element 15 when the latter is in its advanced detachment position, as clearly shown in FIG. 1.

Figure 2:
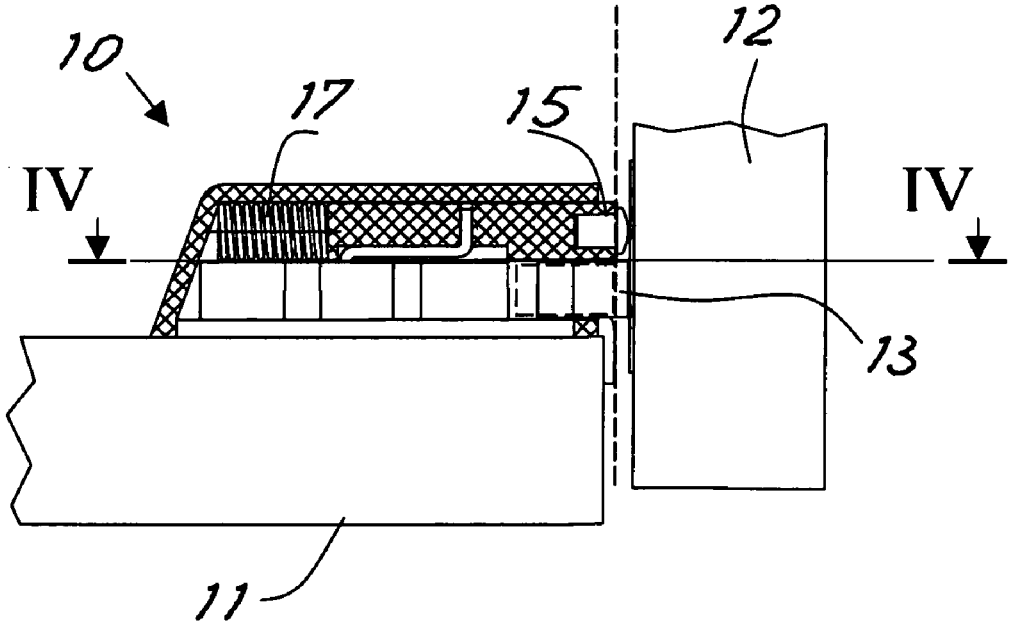
FIG. 2 is a diagrammatic view similar to that in FIG. 1, but with the device in a closed position.

Advantageously, the attraction magnet 13 is freely slidable in parallel to the sliding direction of the thrust element so that it can move backwards in the closing direction and beyond the retracted rest position of the thrust element (as shown in chain line in FIG. 2).

Figure 3:
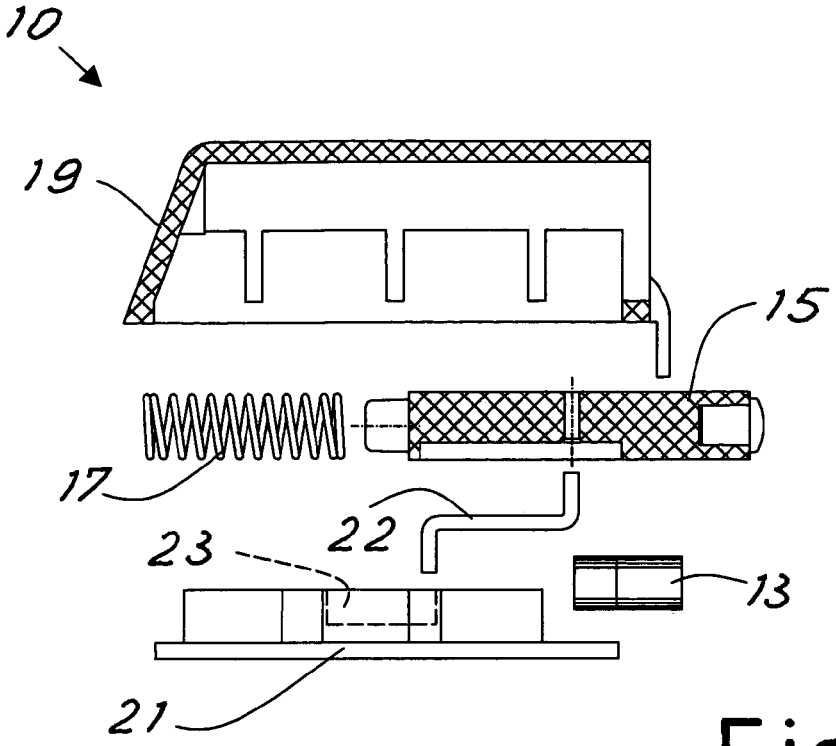
FIG. 3 is an exploded and partly sectioned view of the device in FIG. 1.
Figure 4:
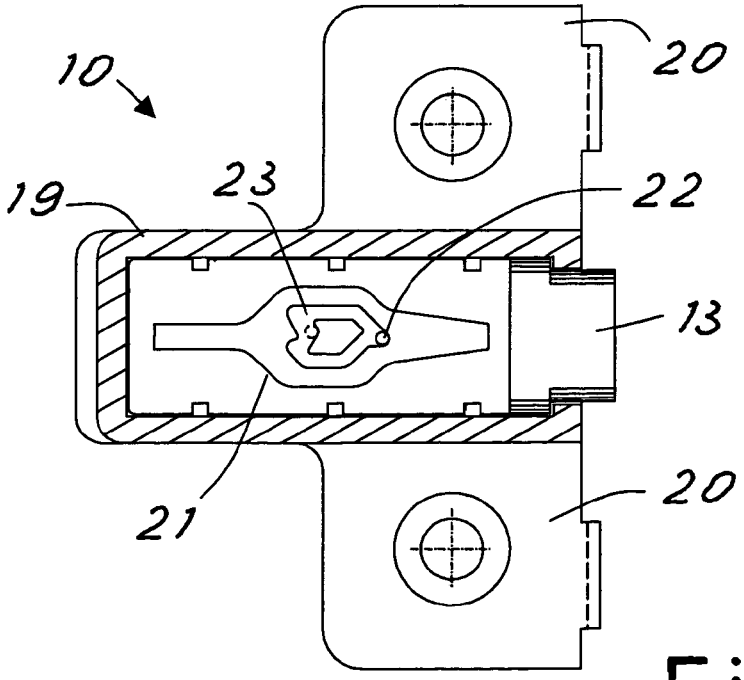
FIG. 4 is a plan view of the device, sectioned along line IV-IV in FIG. 2.

Shown in FIG. 3 is an exploded view of the individual component elements of the device 10 which are received in the shell or housing 19. As clearly illustrated in FIG. 4, the housing 19 advantageously has side wings 20 for fastening to the piece of furniture by use of threaded means for example.

In the just described embodiment, the cam mechanism 16 performing the "pull-push" movement comprises a cam body 21 into which an S-shaped pin element 22 is fitted, which pin element projects from the thrust element 15. As clearly viewed from FIG. 4, the pin that by an end thereof follows channel 23 identified by the cam profiles, is alternately fitted in the advanced position (shown in solid line in FIG. 4) and in the receded position (in chain line in FIG. 4), retaining the thrust element in the corresponding position. For passage from one position to the other, it is sufficient to push the opening part 12 of the piece of furniture against the device 10 beyond the steady closed position shown in FIG. 2, until the farther receded position (or abutment position) shown in chain line still in FIG. 2.

Advantageously, the cam body 21 in one piece also forms the closing lid of the housing 19 bottom.

Figure 5:
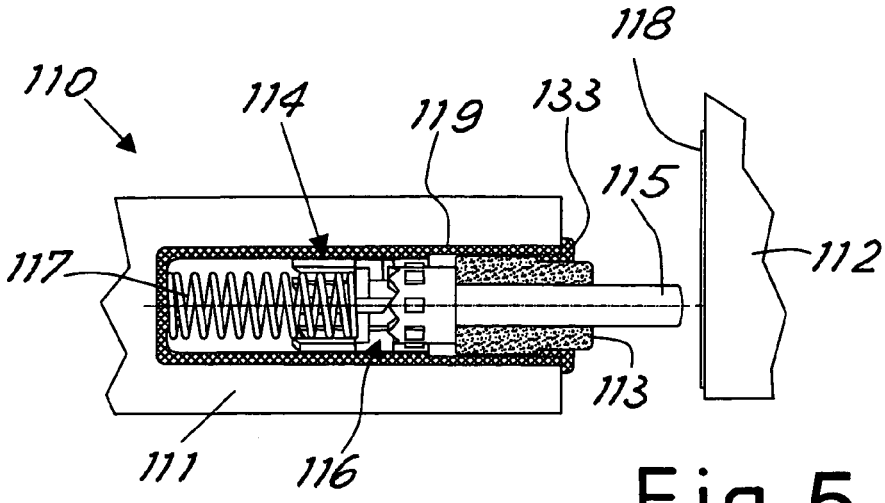
FIG. 5 is a diagrammatic view in longitudinal section of a second embodiment of a closing device in accordance with the invention, in an open position.
Figure 6:
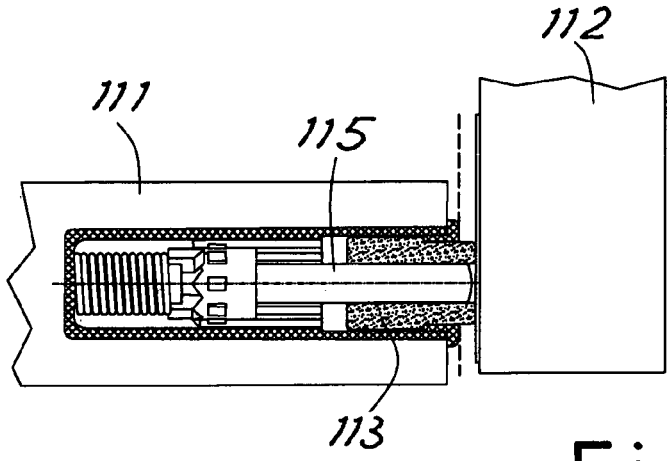
FIG. 6 is a diagrammatic view similar to that in FIG. 5, but with the device in a closed position.
Figure 7:
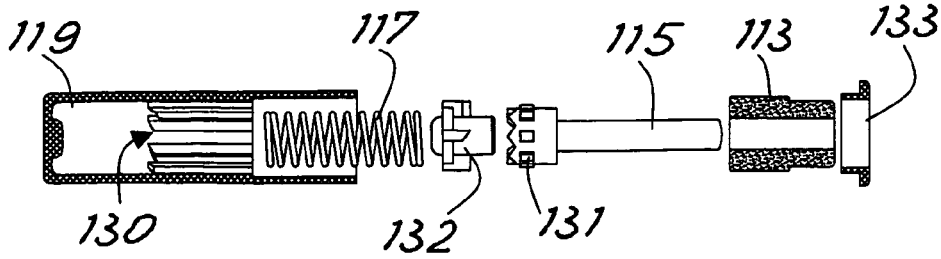
FIG. 7 is an exploded and partly sectioned view of the device in FIG. 5.
Figure 8:
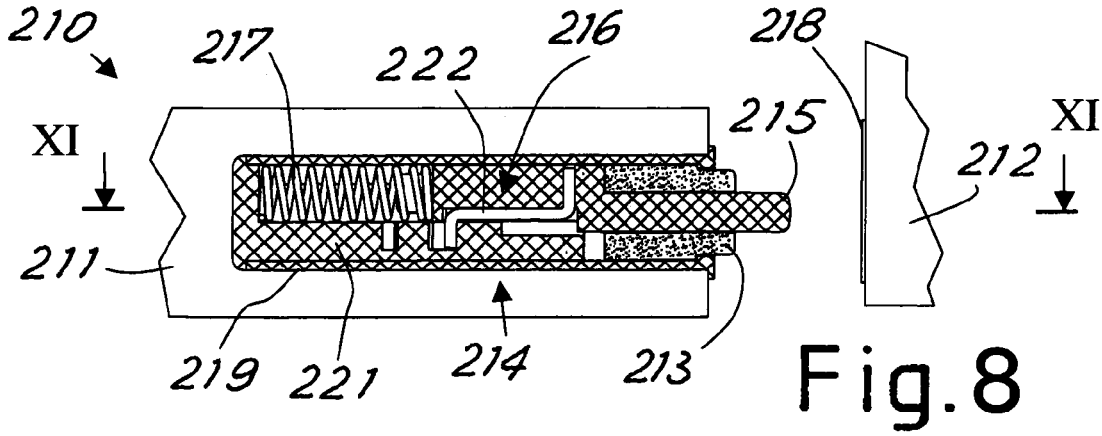
FIG. 8 is a diagrammatic side view in longitudinal section of a third embodiment of a closing device in accordance with the invention, in an open position.
Figure 9:
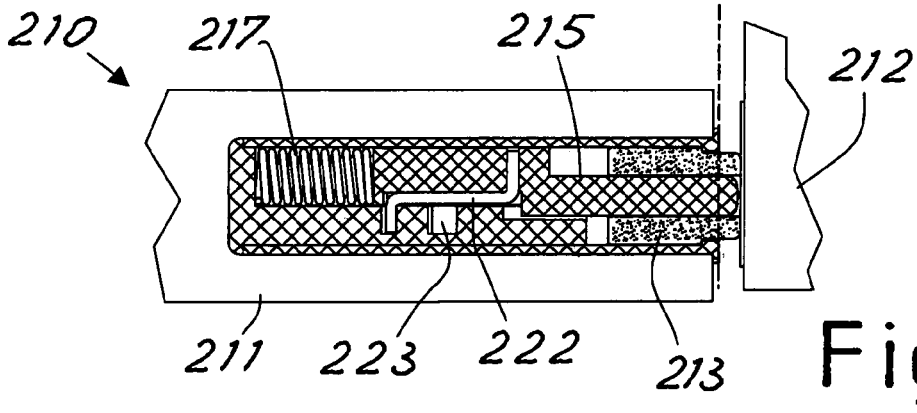
FIG. 9 is a diagrammatic view similar to that in FIG. 8, but with the device in a closed position.
Figure 10:
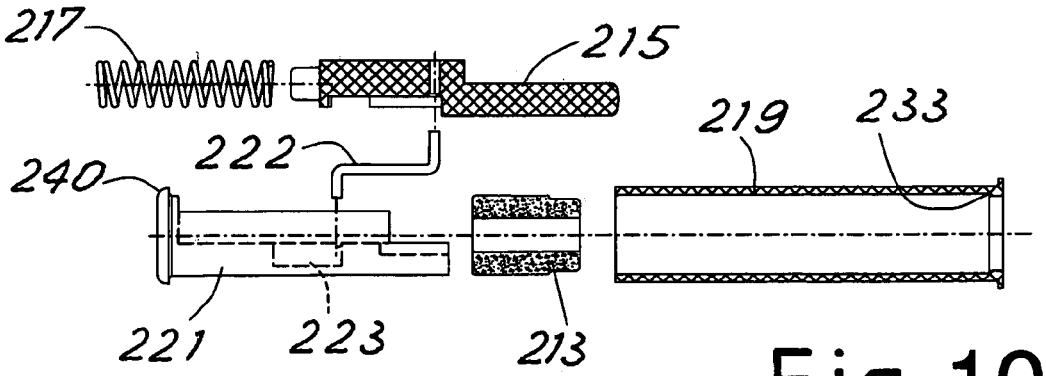
FIG. 10 is an exploded and partly sectioned view of the device in FIG. 8.
Figure 11:
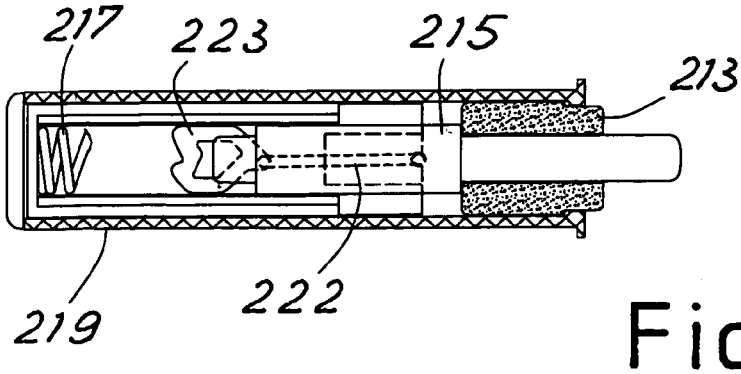
FIG. 11 is a plan view of the device, sectioned along line XI-XI in FIG. 8.

Shown in FIGS. 5 to 7 is a second embodiment of the device of the invention. For convenience, to make elements similar to those of the first embodiment distinguishable, the same reference numerals increased by one hundred will be used.

Therefore, there is a closing device 110 designed to be fastened to the shoulder 111 of a piece of furniture (or other element defining a closeable compartment) to act on an opening part 112 of the piece of furniture. In this second embodiment, the device is made up of a cylindrical housing 119 that is inserted in a suitable hole formed in the piece of furniture, so that an end of the device appears on the piece of furniture and faces element 112, at a plate of ferromagnetic material 118.

Appearing on the end of the device is the thrust element 115 and the attraction magnet 113 that are disposed coaxial, with the magnet advantageously surrounding the thrust element.

Rearwards of the magnet and the thrust element a "pull-push" mechanism 114 is received in the housing 119. The "pull-push" mechanism 114 is of known type with cams 116 provided with front teeth for stepping rotatin, this type being often used as opening/closing mechanism in ball pens. As better shown in FIG. 7, this mechanism 116 comprises guide ribs 130 engaging corresponding teeth 131 on a rear portion of the thrust element 115 provided with a front cam surface acting on a further element 132 to cause a stepping rotation of teeth 131 at each backwards pressure on element 115 (against the thrust of a spring 117), which will bring about an alternated hooking and release action of teeth 131, with and from the rear end of ribs 130.

Two steady positions of the thrust element 115 along its axial stroke are therefore allowed, i.e. one advanced detachment, position (shown in FIG. 5) and one retracted rest position (shown in FIG. 6). For passage from one position to the other it is sufficient for the thrust element to be moved backwards enough beyond the retracted rest position (as shown in chain line in FIG. 6).

Advantageously, the attraction magnet 113 is axially slidable over a short stretch so that it can recede in the closing direction and beyond the retracted rest position of the thrust, element (thereby enabling maneuvering of the latter). A front plug 133 constitutes the forward stop limit of the magnet and keeps the device assembled.

In FIGS. 8 to 11 a third embodiment of the device in accordance with the invention is shown. For convenience, to distinguish elements similar to those of the preceding embodiments, the same reference numerals as those of the embodiment in FIG. 1 but increased by two hundred are used. There is therefore a closing device 210 designed to be fastened to the shoulder 211 of a piece of furniture (or other element defining a closeable compartment) to act on an opening part 212 of the piece of furniture. In this third embodiment, the device is made up of a cylindrical housing 219 that is inserted in a suitable hole formed in the piece of furniture, so that an end of the device appears on the piece of furniture and faces element 212 at a plate of ferromagnetic material 218, in the same manner as in the above described second embodiment.

Appearing on the end of the device is the thrust element 215 and the attraction magnet 213 that are disposed coaxial, with the magnet advantageously surrounding the thrust element.

Received in housing 219, rearwards of the magnet and thrust element is a "pull-push" mechanism 214 formed with a cam mechanism 216 similar to that of the first embodiment described above and identifying the two steady positions against the action of a thrust spring 217.

In particular, the cam mechanism 216 forming the "pull-push" mechanism comprises a cam body 221 into which an S-shaped pin element 222 projecting from the thrust element 215 is fitted. Looking at FIG. 11 (in which spring 217 has been partly removed for the sake of clarity) it is apparent that the pin, which by an end thereof follows a channel 223 defined by the cam profiles, is alternately fitted in the advanced position (FIG. 8) or in the receded position (FIG. 9), retaining the thrust element in the corresponding position. For passage from one position to the other, it is sufficient to open the opening part 212 of the piece of furniture against the device 210 beyond the steady closed position shown in FIG. 9, until the farther receded position (or abutment position) shown in chain line still in FIG. 9.

Advantageously, the cam body 221 in one piece also forms a closing lid or plug for the housing 219 bottom.

As clearly apparent from FIGS. 8-11, when the device 210 is to be assembled, the body 221 receives the slidable element 215 thereon with the thrust spring and S-shaped pin 221, so as to form the movement "pull-push" unit. This unit is then inserted from behind into the tubular housing 219, with interposition of magnet 213. An inner edge 233 close to the end of housing 219 constitutes the magnet stop limit. The rear end of the body 221 has a peripheral edge 240 constituting a stop limit for insertion of body 221 into the housing.

The body 221 can be secured to the housing by pressure or advantageously it can be glued or fastened by ultrasonic-welding.

At this point it is apparent that the intended purposes of the invention have been achieved. By a device in accordance with the invention it is sufficient to move the opening part of the piece of furniture close to the closed position for obtaining hooking of the magnet to the ferromagnetic plate and simultaneously cause passage of the "pull-push" mechanism to the rest position. For reopening, a new thrust on the opening part of the piece of furniture is sufficient to cause release of the "pull-push" mechanism, so that the thrust element operated by the spring suddenly springs out and moves the opening part out of the influence of the magnet.

It is apparent that no precise alignment is required on mounting of the device to the piece of furniture, because the constraint with the opening part of the piece of furniture is merely of the magnetic type. Since no hooking surfaces to be co-coordinated between the two components of the "pull-push" system exist, a minimum accuracy in positioning is required; if tolerances are wished to be increased it is sufficient to increase the plate surface.

In addition, it is clear that there is always a safe and complete release because once the thrust element has sprung out, no constraint (not even of the magnetic type) exists between the opening part and device.

A further advantage is represented by a safe opening; since there are no mechanical members locking the door, should the "pull-push" mechanism fail and should it not enable the thrust element to be pulled out any longer, and as a result, the magnet to be spring-released, it will be merely sufficient to pull the door with a greater force than that exerted by the magnet for opening the door in any case.

In addition, as can be easily imagined, by suitably sizing the forward projection of the magnet and the rest position of the thrust element, it is possible to make the magnet be flush with, or slightly projecting from the thrust end of the thrust element (possibly provided with a rubber bumper) when said magnet is in its outermost position. In this way, in the closed position the opening part of the piece of furniture steadily bears against the thrust element and possible oscillations of the opening part are thus avoided. Since the hooking tooth normally fastened to the door is replaced by a thin metal sheet (0.3 mm thick, for example) that can be screwed down, glued or merely inserted under the finish surface of the door, unaesthetic and dangerous projections are eliminated and no drilling or complicated mounting operations are required.

The second and third embodiments herein described can be made with a much smaller diameter and can be employed in situations where use of a traditional "pull-push" system would be impossible or very uncomfortable.

Obviously, the above description of embodiments applying the innovative principles of the present invention is given by way of example only and therefore must not be considered as a limitation of the scope of the patent rights herein claimed. For instance, if the opening element of the piece of furniture is made up of a ferromagnetic material, the plate 18, 118, 218 can be avoided.

The magnet may also be made of layers consisting of a central magnet and two iron sheets for example, with the purpose of increasing the attraction force, as well known to a person skilled in the art.

What is claimed is:

1. A closing device for an opening part of a piece of furniture, comprising a magnetic detent for retention of said opening part in a closed position in combination with a thrust "pull-push" mechanism for detachment of the opening part from the magnetic detent upon command, so as to cause opening of said opening part, the "pull-push" mechanism comprising a thrust element designed to exert a thrust on the opening part of the piece of furniture to cause detachment of said opening part from the magnetic detent, which thrust element is slidable between a retracted rest position and an advanced detachment position, a cam device enabling alternate and steady passage between the two positions by manual thrust of the thrust element against the action of a spring in the closing direction and beyond the retracted rest position, the device further comprising a cam body in side-by-side relationship with the thrust element, a pin member that projects from the thrust element and is received in the cam body, and the spring is present at the rear of the thrust element for pushing the thrust element towards the advanced detachment position.

2. A device as claimed in claim 1, wherein the magnetic detent comprises a magnet for attraction of an element of ferromagnetic material, the magnet having a front contact surface with the element of ferromagnetic material which projects less than the thrust element when this thrust element is in the advanced detachment position.

3. A device as claimed in claim 2, wherein the attraction magnet is slidable in parallel to the sliding direction of the thrust element to he able to recede in the closing direction and beyond said retracted rest position of the thrust element.

4. A device as claimed in claim 2, wherein the attraction magnet is disposed in side-by-side relationship with the thrust element.

5. A device as claimed in claim 4, wherein it comprises a housing designed to lie fastened by a side thereof to the piece of furniture and containing the thrust element and attraction magnet that project from the housing in side-by-side relationship at a front face of the housing that is designed to Lice said element of ferromagnetic material.

6. A device as claimed in claim 5, wherein the housing is laterally provided with a pair of wings for fastening to the piece of furniture.

7. A device as claimed in claim 2, wherein the element of ferromagnetic material is in the form of a plate.

8. A closing device for an opening part of a piece of furniture, comprising a magnetic detent for retention of said opening part in a closed position in combination with a thrust "pull-push" mechanism for detachment of the opening part from the magnetic detent upon command, So as to cause opening of said opening part, the "pull-push" mechanism comprising a thrust element designed to exert a thrust on the opening part of the piece of furniture to cause detachment of said opening part from the magnetic detent, which thrust element is slidable between a retracted rest position and an advanced detachment position, a cam device enabling alternate and steady passage between the two positions by manual thrust of the thrust element against the action of a spring in the closing direction and beyond the retracted rest position, the magnetic detent comprising a magnetic retention element and the thrust element axially passing through the magnetic retention element.

9. A device as claimed in claim 8, wherein the magnetic retention element is a magnet for attraction of an element of ferromagnetic material arranged on the opening part of a piece of furniture, the magnet having a front contact surface with the element of ferromagnetic material which projects less than the thrust element when this thrust element is in the advanced detachment position.

10. A device as claimed in claim 9, wherein the attraction magnet is slidable in parallel to the sliding direction of the thrust element to be able to recede in the closing direction and beyond said retracted rest position of the thrust element.

11. A device as claimed in claim 9, wherein the attraction magnet is disposed coaxial with the thrust element.

12. A device as claimed in claim 9, wherein it comprises a cylindrical housing designed to be fitted into a hole in a piece of furniture and containing the thrust element and attraction element which project from one end of the cylindrical housing, this end being designed to appear at the hole to face said element of ferromagnetic material.

13. A device as claimed in claim 12, wherein said cam device is of the type provided with front teeth for stepping rotation and is disposed within the housing at the rear of the magnet and the thrust element.

14. A device as claimed in claim 12, wherein the spring for pushing the trust element towards the advanced detachment position is present rear-wards of the cam device.

15. A device as claimed in claim 9, wherein the element of ferromagnetic material is in the form of a plate.

16. A device as claimed in claim 12, wherein the cam device is inserted in the housing from the opposite end relative to that from which the thrust element projects and one portion of the cam device constitutes a closure for this opposite end.

* * * * *